US008450591B2

(12) United States Patent
Abrego

(10) Patent No.: US 8,450,591 B2
(45) Date of Patent: May 28, 2013

(54) METHODS FOR GENERATING NEW OUTPUT SOUNDS FROM INPUT SOUNDS

(75) Inventor: Gustavo Hernandez Abrego, Foster City, CA (US)

(73) Assignee: Sony Computer Entertainment Inc., Tokyo (JP)

( * ) Notice: Subject to any disclaimer, the term of this patent is extended or adjusted under 35 U.S.C. 154(b) by 0 days.

(21) Appl. No.: 13/020,776

(22) Filed: Feb. 3, 2011

(65) Prior Publication Data

US 2011/0126694 A1 Jun. 2, 2011

Related U.S. Application Data

(62) Division of application No. 11/542,699, filed on Oct. 3, 2006, now Pat. No. 7,902,447.

(51) Int. Cl.
*A63H 5/00* (2006.01)
*G04B 13/00* (2006.01)

(52) U.S. Cl.
USPC ..... 84/609; 84/615; 84/649; 84/653

(58) Field of Classification Search
None
See application file for complete search history.

(56) References Cited

U.S. PATENT DOCUMENTS

| | | | | |
|---|---|---|---|---|
| 5,768,498 | A | 6/1998 | Boigelot et al. | 714/39 |
| 5,983,180 | A * | 11/1999 | Robinson | 704/254 |
| 6,059,837 | A | 5/2000 | Kukula et al. | 703/27 |
| 6,172,675 | B1 * | 1/2001 | Ahmad et al. | 715/251 |
| 6,691,078 | B1 | 2/2004 | Beer et al. | 703/14 |
| 7,072,880 | B2 * | 7/2006 | Beesley | 1/1 |
| 7,169,996 | B2 | 1/2007 | Georges et al. | 84/609 |
| 7,321,854 | B2 * | 1/2008 | Sharma et al. | 704/243 |
| 7,552,051 | B2 | 6/2009 | Privault et al. | 704/255 |
| 7,765,574 | B1 | 7/2010 | Maybury et al. | 725/105 |
| 7,784,008 | B1 | 8/2010 | Hutton et al. | 716/126 |
| 7,902,447 | B1 * | 3/2011 | Abrego | 84/609 |
| 2001/0041978 | A1 | 11/2001 | Crespo et al. | 704/257 |
| 2002/0032564 | A1 | 3/2002 | Ehsani et al. | 704/235 |
| 2005/0209849 | A1 * | 9/2005 | Abrego et al. | 704/235 |
| 2006/0031071 | A1 * | 2/2006 | Abrego et al. | 704/256 |
| 2006/0036438 | A1 * | 2/2006 | Chang | 704/235 |
| 2007/0038451 | A1 * | 2/2007 | Cogne et al. | 704/256 |
| 2008/0027725 | A1 * | 1/2008 | Chu et al. | 704/257 |

FOREIGN PATENT DOCUMENTS

| | | |
|---|---|---|
| EP | 0 854 468 A2 | 7/1998 |

* cited by examiner

*Primary Examiner* — Marlon Fletcher
(74) *Attorney, Agent, or Firm* — Martine Penilla Group, LLP

(57) ABSTRACT

Methods for dynamically analyzing input sounds and processing the input sounds to define a new set of output sounds are provided. One method includes receiving a first set of input sounds and a second set of input sounds, where each of the first and second sets of input sounds are processed to identify one of a tone, intensity, or frequency, and a duration. The method defines a node for each identified input sound and a link between the input sounds of the first and second sets of input sounds. The nodes and links from the first and second sets of input sounds create a respective first and second finite state automata. A history value is defined for processing the nodes of the first and second sets of input sounds, and the history value defines a number of previous nodes that will be identical in each of the first and second sets of input sounds before a particular node is shared between the first and second sets of input sounds. Then, the method forms the new set of output sounds from a third finite state automaton that includes nodes from the first and second set of input nodes and nodes that are shared based on meeting the history value.

12 Claims, 15 Drawing Sheets

METHODS FOR GENERATING NEW OUTPUT SOUNDS FROM INPUT SOUNDS

CLAIM OF PRIORITY

This application is a divisional application of U.S. application Ser. No. 11/542,699, filed on Oct. 3, 2006, now U.S. Pat. No. 7,902,447 and entitled "Automatic Composition of Sound Sequences Using Finite State Automata," which is herein incorporated by reference.

CROSS REFERENCE TO RELATED APPLICATIONS

This application is related to U.S. application Ser. No. 11/437,444, filed May 19, 2006 and entitled, Structure for Grammar and Dictionary Representation in Voice Recognition and Method for Simplifying Link and Node-Generated Grammars, and U.S. application Ser. No. 12/780,818, filed on May 14, 2010, and entitled Method and System for Grammar Fitness Evaluation as Speech Recognition Error Predictor," both of which are herein incorporated by reference.

BACKGROUND OF THE INVENTION

1. Field of the Invention

The present invention relates generally to the automatic composition of music and/or sounds.

2. Description of the Related Art

The automatic composition of music is something that can be enjoyed by amateurs and professionals. While the variations in musical compositions are endless, the quality of a musical composition is difficult to quantify because what sounds good to one person may sound discordant to another. The wide variety of musical styles and compositions can make it difficult to begin a composition.

There are computer programs that can assist in the composition of music based on input from a user such as time signatures and chord progressions. The requirement for a user to know chord progressions and other musical terminology can be a barrier that prevents a user with no musical knowledge from using such programs. The underlying algorithms that determine how musical notes are combined and transitioned may also be limited to a specific ethnic and cultural musical aesthetic.

In view of the forgoing, there is a need for automatic composition of musical sequences capable of encompassing many styles of musical composition.

SUMMARY

In one embodiment, a method for dynamically analyzing input sounds and processing the input sounds to define a new set of output sounds, is provided. The method includes receiving a first set of input sounds and a second set of input sounds, where each of the first and second sets of input sounds are processed to identify one of a tone, intensity, or frequency, and a duration. The method defines a node for each identified input sound and a link between the input sounds of the first and second sets of input sounds. The nodes and links from the first and second sets of input sounds create a respective first and second finite state automata. A history value is defined for processing the nodes of the first and second sets of input sounds, and the history value defines a number of previous nodes that will be identical in each of the first and second sets of input sounds before a particular node is shared between the first and second sets of input sounds. Then, the method forms the new set of output sounds from a third finite state automaton that includes nodes from the first and second set of input nodes and nodes that are shared based on meeting the history value.

In another embodiment, a method for the automatic composition of music is disclosed. The method begins by receiving a plurality of input sound sequences containing sound frequencies with corresponding time duration. The method continues with converting the plurality of input sound sequences to a finite state automaton using a system that allows over-generation, followed by receiving exploration rules that constrain how the finite state automaton is to be traversed. The next step is creating a path marker data structure indexing a plurality of path markers, where each path marker contains a path marker history and a path marker registry. After the path marker data structure is created, the method continues by traversing the finite state automaton with a graph exploration procedure that uses the exploration rules and the plurality of path markers to determine path across the finite state automaton. During the exploration the path marker history and the path marker registry of particular path markers are updated when traversing the finite state automaton. As the finite state automaton is traversed the method includes storing the paths across the finite state automaton to the path marker data structure to define recorded path markers, wherein the recorded path markers that are not found in the plurality of input sound sequences define a new music composition.

In yet another embodiment a computer readable media including program instructions for composing music is disclosed. The computer readable media includes program instructions for receiving a plurality of input sound sequences containing sound frequencies and corresponding and time durations. The computer readable media also includes program instructions for converting the plurality of input sound sequences to a finite state automaton using a system that allows over-generation. Program instructions for traversing the finite state automaton using a graph exploration procedure that uses exploration rules and a plurality of path markers to determine paths across the finite state automaton are also included. The computer readable media also includes program instructions for storing the paths across the finite state automaton to a path marker data structure to define recorded path markers. Wherein the recorded path markers that are not found in the plurality of input sound sequences define a new sound sequences.

In still another embodiment a method for generating new sound sequences based on input sounds is disclosed. The method is initiated by receiving a plurality of input sound sequences containing sound frequencies with corresponding time duration. The method continues by converting the plurality of input sound sequences to a finite state automaton using a system that allows over-generation. The next operation of the method is traversing the finite state automaton with a graph exploration procedure that uses exploration rules and a plurality of path markers to determine paths across the finite state automaton. The method continues by storing the paths across the finite state automaton to a path marker data structure to define recorded path markers, wherein the recorded path markers that are not found in the plurality of input sound sequences define a new sound sequence.

Other aspects and advantages of the invention will become apparent from the following detailed description, taken in conjunction with the accompanying drawings, illustrating by way of example the principles of the invention.

BRIEF DESCRIPTION OF THE DRAWINGS

The invention, together with further advantages thereof, may best be understood by reference to the following description taken in conjunction with the accompanying drawings.

DETAILED DESCRIPTION

An invention is disclosed for automatically generating new sound combinations derived from input sounds having frequencies and temporal duration. For example, in one embodiment of the invention a microphone can input sound frequencies and durations that are used as the basis for a new combination of sound frequencies and duration. In another example, the invention could input a written musical composition to generate new musical composition. In the following description, numerous specific details are set forth in order to provide a thorough understanding of the present invention. It will be apparent, however, to one skilled in the art that the present invention may be practiced without some or all of these specific details. In other instances, well known process steps have not been described in detail in order not to unnecessarily obscure the present invention.

Broadly defined, "music" may be understood as a series of sound frequencies where the sound frequencies have a specified magnitude, intensity, and/or temporal duration. Music, being a sequence of notes, can be represented by a finite state automaton. In one embodiment, a finite state automaton is a transitional model composed of states and transitions. A FSA may be interpreted as a directed graph because the transition can have a direction. In one embodiment the states, also referred to as nodes, of the FSA, may represent a musical note having a frequency and duration. A transition between notes/states/nodes can be represented by a link connecting states/nodes in the FSA. The finite state automaton can be constructed in any number of ways. For instance, the finite state automaton may initially be constructed by parsing input sounds. The input sounds may be, in one embodiment, a set of sounds or a music clip. Once the finite state automaton is created, post processing and analysis may dictate a degree of generation that can be applied to the linking of nodes. Thus, new finite state automata can be created, defining new music or groups of sounds. In one embodiment, the new node combinations can be viewed as a new musical composition. As will be defined below in more detail, traversing the finite state automaton and applying a path marker, in accordance with one embodiment of the present invention, can generate the new node combinations. For instance, as the finite state automaton is traversed, a path maker can record the progression across the nodes. The node sequences within the path markers may allow for the recreation of the original music when the sound frequencies and durations captured within the nodes are given a sound or musical voice.

Figure 1:
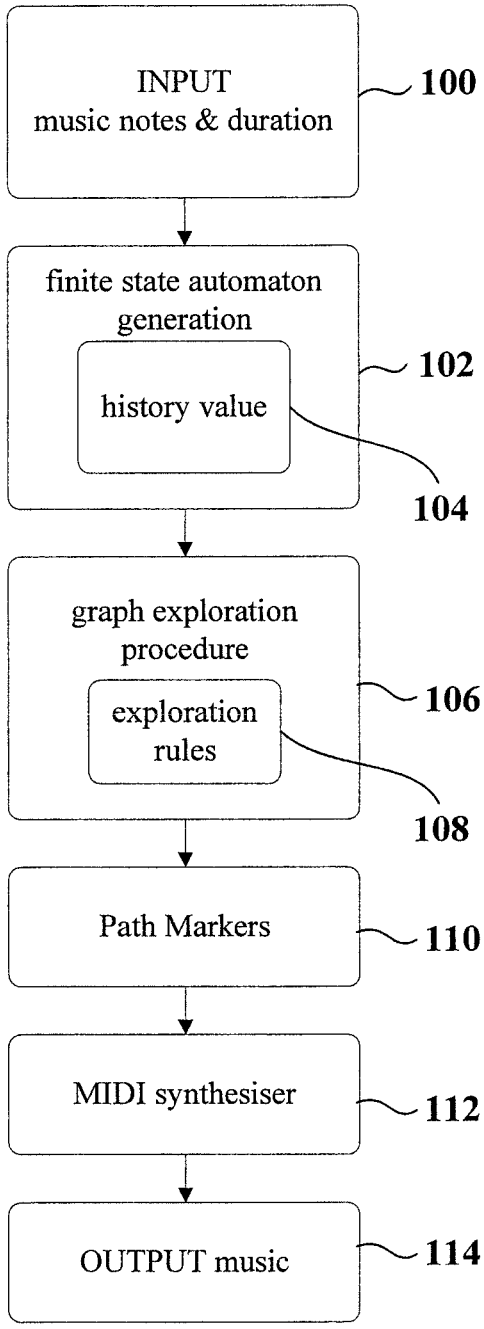
FIG. 1 shows a flowchart illustrating a procedure to generate music in accordance with one embodiment of the present invention.

FIG. 1 shows a flowchart illustrating a procedure to generate music in accordance with one embodiment of the present invention. The procedure begins with operation 100 with the input of musical notes, defined by a sound frequency and duration. In one embodiment the musical notes can be input using a microphone and recording the sounds using a computer. In another embodiment, a written piece of music can be optically scanned and analyzed by a computer to determine the sound frequency and duration of the musical notes. In another embodiment, music can be represented a sequence of symbols that encode the note and its duration in a text format. In another embodiment the musical notes can be directly entered into a computer using a music composition program.

After operation 100 the procedure moves to operation 102 where a computer analyzes the musical notes and generates a finite state automaton. The finite state automaton is based on the sequence of musical notes and a user-defined history value allows over-generation within the finite state automaton. A more detailed description of how the history value 104 controls over-generation can be found below.

In operation 106 a graph exploration procedure is used to traverse the finite state automaton. The graph exploration procedure is prevented from entering infinite loops within the finite state automaton by exploration rules 108. The output of the operation 106 are paths that are saved in path markers 110. A path is a sequence of nodes that can be repeated, and in one embodiment, may be the result of traversing the FSA. Because the transition between two states/nodes may be determined by the transitions/links, a path may be a string of links. Path markers 110 can be used to record information regarding the paths taken through the finite state automaton. Included within the path markers are the original musical notes and possibly new combinations of musical notes. A more thorough description of the role path makers can be found in the discussion of FIG. 4.

Because the path markers contain the possible combination of the finite state automaton, operation 112 uses the path markers in conjunction with a Musical Instrument Digital Interface (MIDI) synthesizer to generate sounds. The midi synthesizer gives the sound frequency and duration of the individual nodes stored within the path markers a "voice" such as a piano, trumpet, or other synthesized or recorded sound. Operation 114 outputs the musical notes as sounds from the MIDI synthesizer. In another embodiment the path markers can be turned into a written musical form capable of being displayed on a monitor, stored on computer readable media, or printed. In yet another embodiment the musical notes stored within the path markers are given a voice using a sound reproduction method other than MIDI.

Figure 2A:
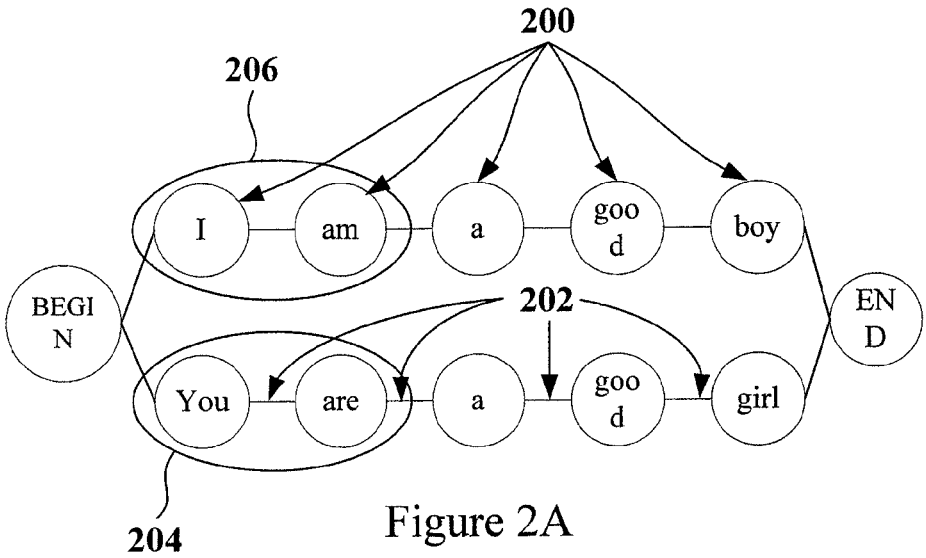
FIG. 2A is a finite state representation of the sentences, "I am a good boy." and "You are a good girl." created with a history value of two, in accordance with one embodiment of the present invention.
Figure 2B:
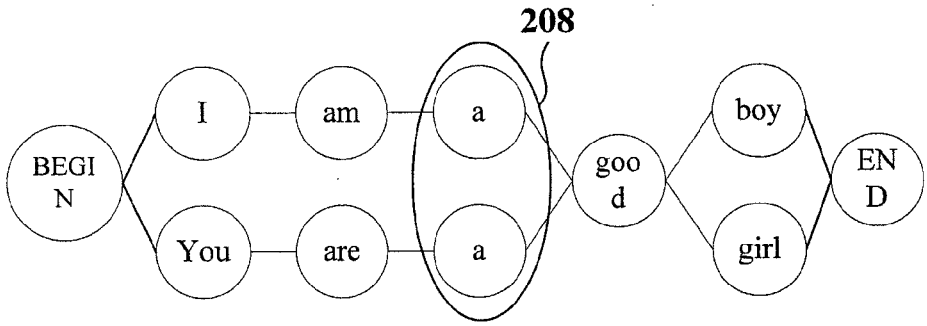
FIG. 2B is a finite state representation of the sentences, "I am a good boy." and "You are a good girl." created with a history value of one, in accordance with one embodiment of the present invention.
Figure 2C:
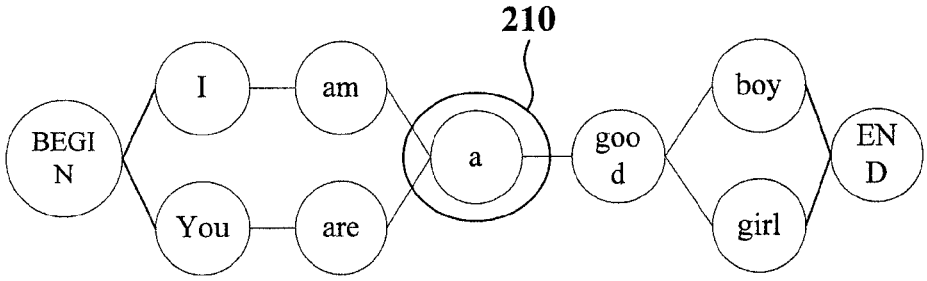
FIG. 2C is a finite state representation of the sentences, "I am a good boy." and "You are a good girl." created with a history value of zero, in accordance with one embodiment of the present invention.

FIGS. 2A-2C are examples of different FSA composed of nodes 200 and links 202 created from the same input that demonstrate how varying the history value 104 can control over-generation. Over-generation occurs when the graph exploration procedure traverses the finite state automaton and results in combinations not present in the original input. The ability of the finite state automaton to over-generate may be controlled by a history value 104 that is user defined. The history value 104 specifies the number of preceding nodes that must be identical before creating a new node. A large history value, one that requires multiple preceding nodes to be identical before generating a new node, may result in the creation of a larger number of discrete nodes and lower amounts of over-generation. Conversely, a history value that requires few or no identical preceding nodes can result in higher amounts of over-generation.

FIG. 2A is a node 200 and link 202 representation of the sentences, "I am a good boy." and "You are a good girl." created with a history value of two, in accordance with one embodiment of the present invention. For simplicity, the examples given in FIGS. 2A-2C use words instead of sound frequencies and durations. Using a history value of two, the first sentence "I am a good boy." results in individual nodes for each word. The next sentence is analyzed in light of the first sentence and a history value of two. When a common word/node is found, the preceding two words/nodes of the second sentence are compared to the preceding two words/nodes of the common word in the first sentence. If the preceding two words/nodes are the same in each respective sentence, the node becomes shared. If the two preceding nodes are not the same, a new node will be generated for the word/node in the second sentence.

Thus, using a history value of two when analyzing the sentence "You are a good girl." with respect to the sentence "I am a good boy", even though there appears to be the common node "a", because the two preceding nodes "You are" 204 are not the same as "I am" 206 the pre-existing "a" node will not be shared and a new node will be created for the "a" in "You are a good girl." Similarly, the two preceding nodes before "good", "am a", do not match "are a" so a new node will be created for "good" in the sentence "You are a good girl." Note that traversing the finite state automaton in FIG. 2A results in the original input sentences, therefore over-generation did not occur.

FIG. 2B is a node and link representation of the sentences, "I am a good boy." and "You are a good girl." created with a history value of one, in accordance with one embodiment of the present invention. The history value of one allows a node to be shared if the preceding word to the commonly shared word is identical. Because the nodes 208 representing the word "a" are identical, the node representing "good" can be shared. Traversing the node structure in FIG. 2B reveals over-generation because two additional sentences, "I am a good girl." and "You are a good boy." are now possible.

FIG. 2C is a FSA representation of the sentences, "I am a good boy." and "You are a good girl." created with a history value of zero, in accordance with one embodiment of the present invention. With a history value of zero, common words are automatically shared because zero preceding words need to match. For example, the node representing "a" 210 can be shared. In FIG. 2C the finite state automaton created with a history value of zero does not change the sentences created by the finite state automaton but does illustrate how decreasing the history value can result in over-generation by sharing more nodes within the finite state automaton.

The over-generation demonstrated with words in FIGS. 2A-2C can lead to "new" music based on existing input when over-generation using a finite state automaton is applied to sound input. Furthermore, because the finite state automaton is based on sound input that is decomposed into sound frequencies and durations the new musical compositions can maintain ethnic or cultural themes and sounds.

Figure 3:
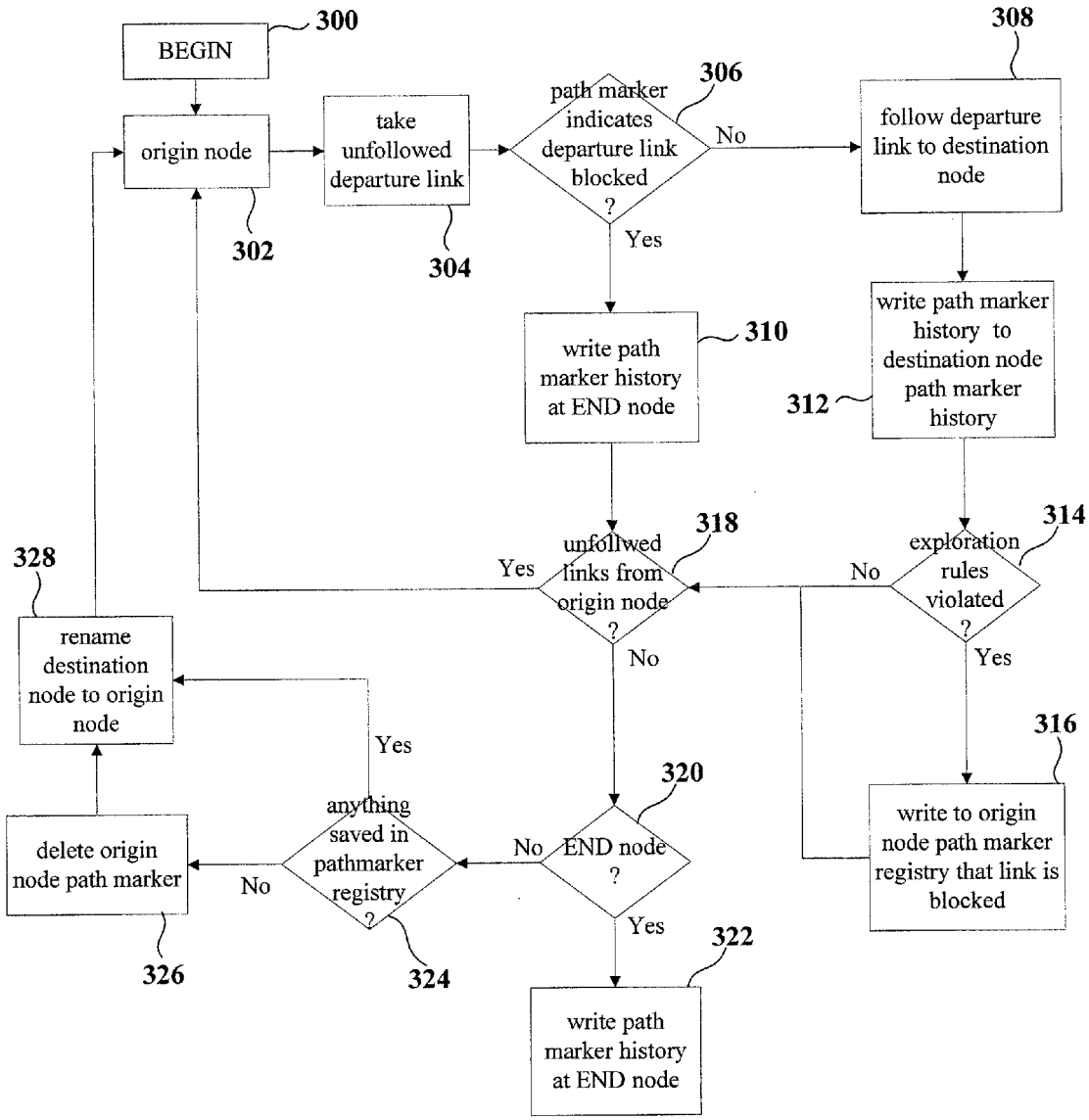
FIG. 3 shows a flowchart illustrating a procedure for a graph exploration procedure to traverse the Finite State Automaton (FSA) in accordance with one embodiment of the present invention.

FIG. 3 shows a flowchart illustrating a procedure for an exhaustive graph exploration procedure to traverse the finite state automaton in accordance with one embodiment of the present invention. The flowchart illustrates one of many possible procedures that may be used to traverse and record all of the possible sequences of the finite state automaton. Thus, the flowchart is not intended to be restrictive. The procedure begins as indicated at BEGIN 300 and proceeds to operation 302 that designates the first node available as an origin node. Continuing to operations 304 and 306 the procedure indicates taking an un-followed departure link and checking the path marker registry to see if the departure link is blocked. If the departure link is not blocked the procedure continues to operation 308 where the departure link is followed to a destination node. Alternatively, if the departure link is blocked, the procedure advances to operation 310 where the path marker history is written at the END node. From operation 310 the procedure continues to operation 318 to determine if there are any un-followed links from the origin node.

Returning to the completion of operation 308, the procedure advances to operation 312 that writes the path marker history from the origin node to the path marker history for the destination node. The next step, operation 314, examines the path marker registry to determine if there are violations of exploration rules. Since the finite state automaton can be created with recursive paths (repeated notes or musical phrases included in the input sequences) it is possible that the graph exploration procedure could become mired in an infinite loop. The exploration rule is a user-defined value that examines the path marker history for repetitive loops and blocks the link if the exploration rule is violated. For example, the exploration rule can be set to examine the path marker history for four nodes that have been repeated three times. Therefore, when the graph exploration procedure attempts to traverse the same nodes for a fourth time the link will be blocked. In another embodiment it would be possible to assign different exploration rules to different portions of the musical composition. Having varying exploration rules would allow a user to have increased flexibility regarding portions of the musical composition such as the chorus or main theme. There are many possible variations of exploration rules because a user can define the number of nodes to examine and the number of times a loop can be repeated before the link is blocked. The examples given are not intended to be restrictive but rather exemplary of implementations of various exploration rules.

If the exploration rules have been violated, the procedure proceeds with operation 316 and writes to the path marker registry of the origin node that the specific link is blocked. The procedure continues to operation 318, which is also the destination if the exploration rules of operation 312 are not violated.

If there are un-followed links from the origin node, operation 318 returns the procedure to operation 302. If all of the links from the origin node have been followed, operation 318 advances the procedure to operation 320. Operation 320 checks if the procedure has traversed the nodes and arrived at the END node. If the exploration has come to the END node the procedure continues to operation 322 where the path marker history is written at the END node. If the graph exploration procedure has not reached the END node, operation 324 examines the path marker registry to see if any blocked links are saved. If there are no blocked links saved in the path marker registry, the procedure advances to operation 326 where the origin node path marker is deleted. Completion of operation 326 advances the procedure to operation 328 where the destination node is renamed as the origin node. Operation 328 is also the destination if operation 324 finds blocked links saved in the path marker registry. Following operation 328 the procedure returns to operation 302.

In another embodiment, a partial exploration of the FSA may be conducted. During a partial exploration, it is possible that only a portion of all of the sequences included in the FSA are generated. Partial exploration can allow the rapid generation of one or many paths as opposed to the generation of all the possible paths that can be a lengthy operation. The types of user-defined limitation controlling a partial exploration are unlimited. One example is a time duration ensuring that a partial exploration is completed within a user specified time period. Another example is terminating the partial exploration after a user specified number of sequences have been saved in the path marker history of the END node. It would also be possible to use combinations of user-defined limitations to control a partial exploration. As previously mentioned, there can be unlimited number of user defined limitations to control partial explorations and the particular examples provided are not intended to be restrictive.

Figure 4:
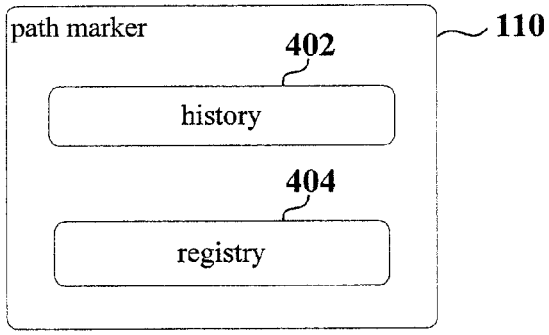
FIG. 4 is a representation of a path marker 110 in accordance with one embodiment of the present invention.

FIG. 4 is a representation of a path marker 110 in accordance with one embodiment of the present invention. The path marker can be used to temporarily store the information regarding how the finite state automaton was traversed to get to the current position. The path marker contains a history 402 where the previous nodes that have been traversed are recorded. The path marker also contains a registry 404 to record links that are blocked. As previously discussed, a link can become blocked if the exploration rules are violated. Path markers can be deleted after all of the departure links from a node have been followed. Path markers can also be saved if information in the registry 404 indicates that a link is blocked. The final path marker at the END node can contain the sequences of nodes that can completely traverse the finite state automaton.

Figure 5:
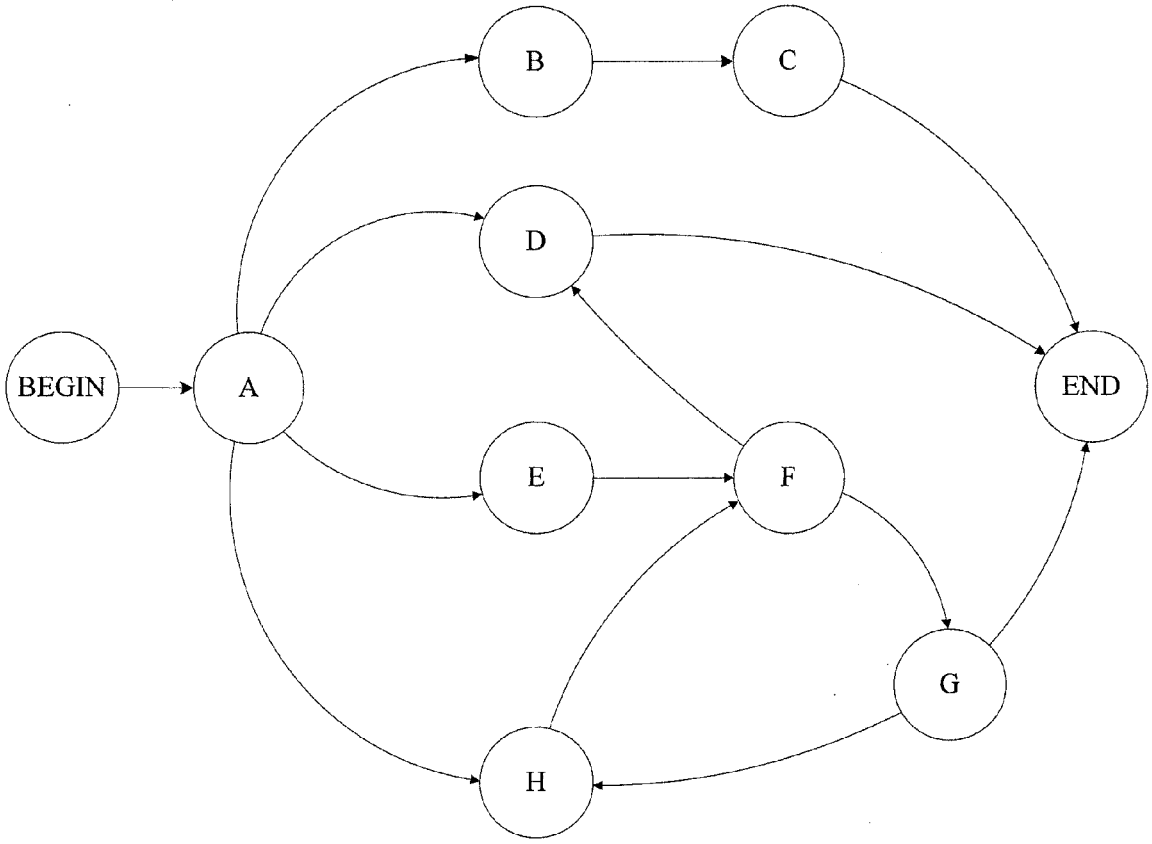
FIG. 5 is an example of a finite state automaton that is capable of over-generation in accordance with one embodiment of the present invention.

FIG. 5 is an example of a finite state automaton that is capable of over-generation in accordance with one embodiment of the present invention. To demonstrate the procedure in FIG. 3 the finite state automaton in FIG. 5 will be traversed step by step.

Figure 5A:
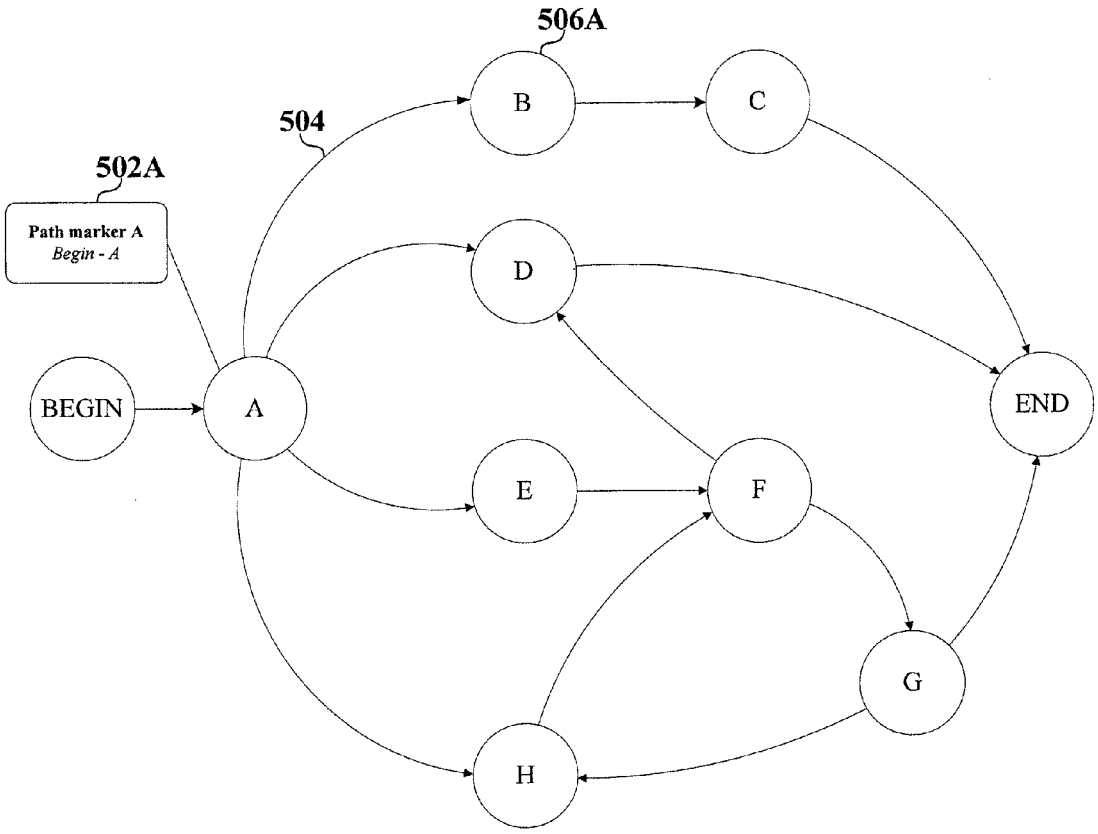
FIGS. 5A-5K show different stages of traversing the finite state automaton of FIG. 5 using a graph exploration procedure in accordance with one embodiment of the present invention.

Viewing FIG. 3 and FIG. 5 the procedure begins as indicated with the BEGIN node being designated as the origin node. Using operations 304 and 306 there is one un-followed departure link from the BEGIN node and the un-followed departure link is unblocked. The result of operation 308 is arriving at destination node A. Completion of operation 312 results in what is shown in FIG. 5A where the path marker A 502A for the destination node A is shown. Continuing through operation 314 and 318 the exploration rules were not violated and there are no unfollowed links from the BEGIN node. Because the FSA has not reached the END node, execution of operation 320 results in the deletion of the path marker for the BEGIN node and node A is renamed as the origin node.

Figure 5B:
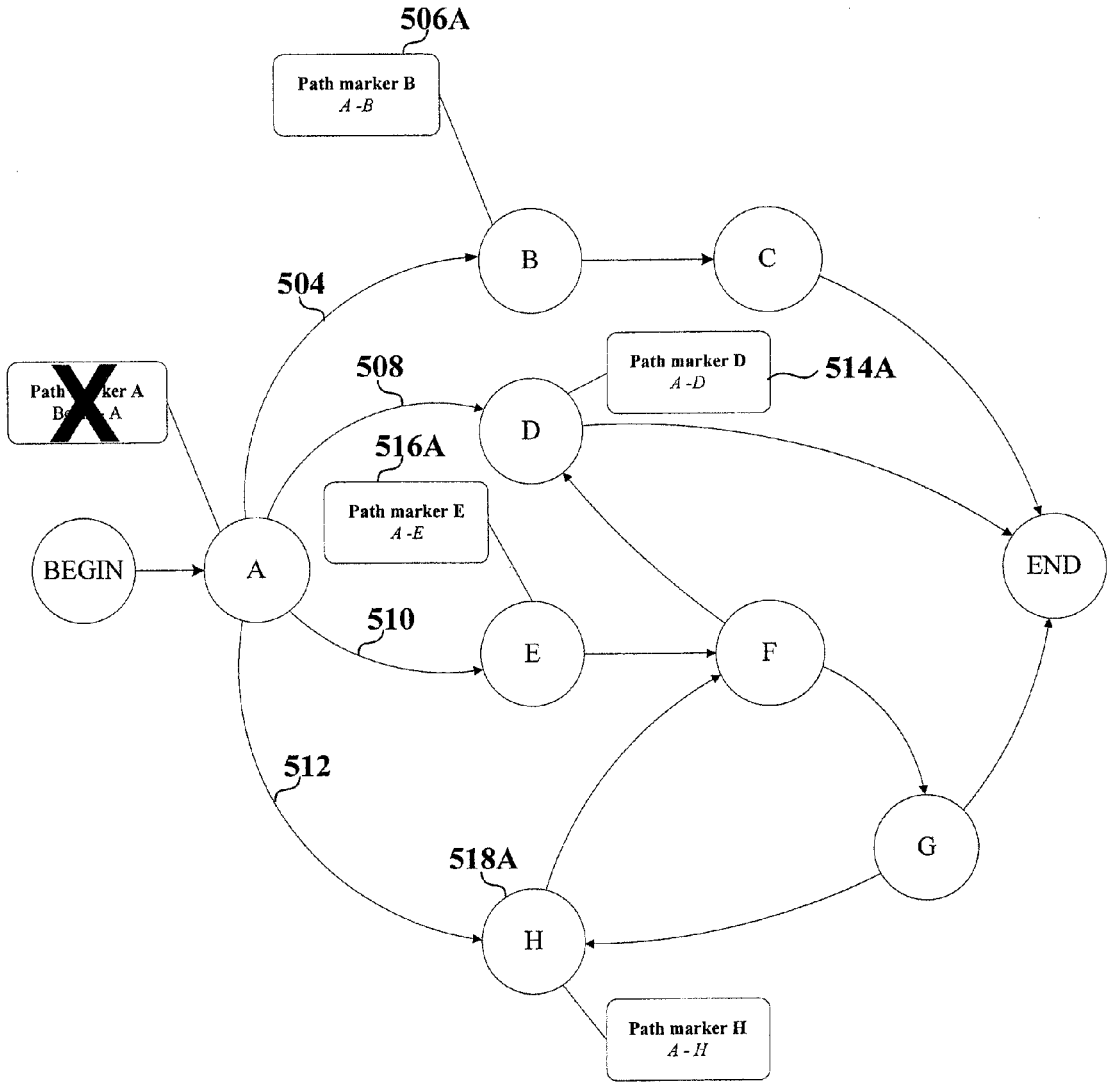

With node A designated the origin node the procedure returns to operation 302. Referencing FIG. 5A, performing operation 304 results in taking departure link 504. Completion of operation 306 determines that the departure link 504 is not blocked and results in arriving at operation 308. Operations 308 and 312 results in arriving at node B and writing the path marker B 506A, as shown in FIG. 5B. Conducting operation 314 leads to operation 318 where, because there are un-followed links from node A, the procedure returns to operation 302. As written above and as shown in FIG. 3 the complete traversing of the finite state automaton can be accomplished following one departure link at a time. However, for simplicity and expedience the remainder of this disclosure will disclose the results from taking multiple departure links simultaneously when possible.

Referring to FIG. 5B and resuming the procedure at node A, executing operations 304, 306, and 308 results in departure links 508, 510 and 512 being followed to nodes D, E, and H respectively. Completing operation 312 creates the path markers 514A, 516A and 518A. The exploration rules of operation 314 are not violated by any of the departure links and because there are no unfollowed links from node A 502, the procedure advances to operation 320. Because the exploration has not reached the END node the next step is operation 324. Since nothing is saved in the path marker registries for nodes B, D, E, and H the next step is operation 326. The result of operation 326 is the deletion of the path marker A 502A, as shown with the "X". The result from progressing through operation 328 is the designation of nodes B, D, E, and H as origin nodes.

Figure 5C:
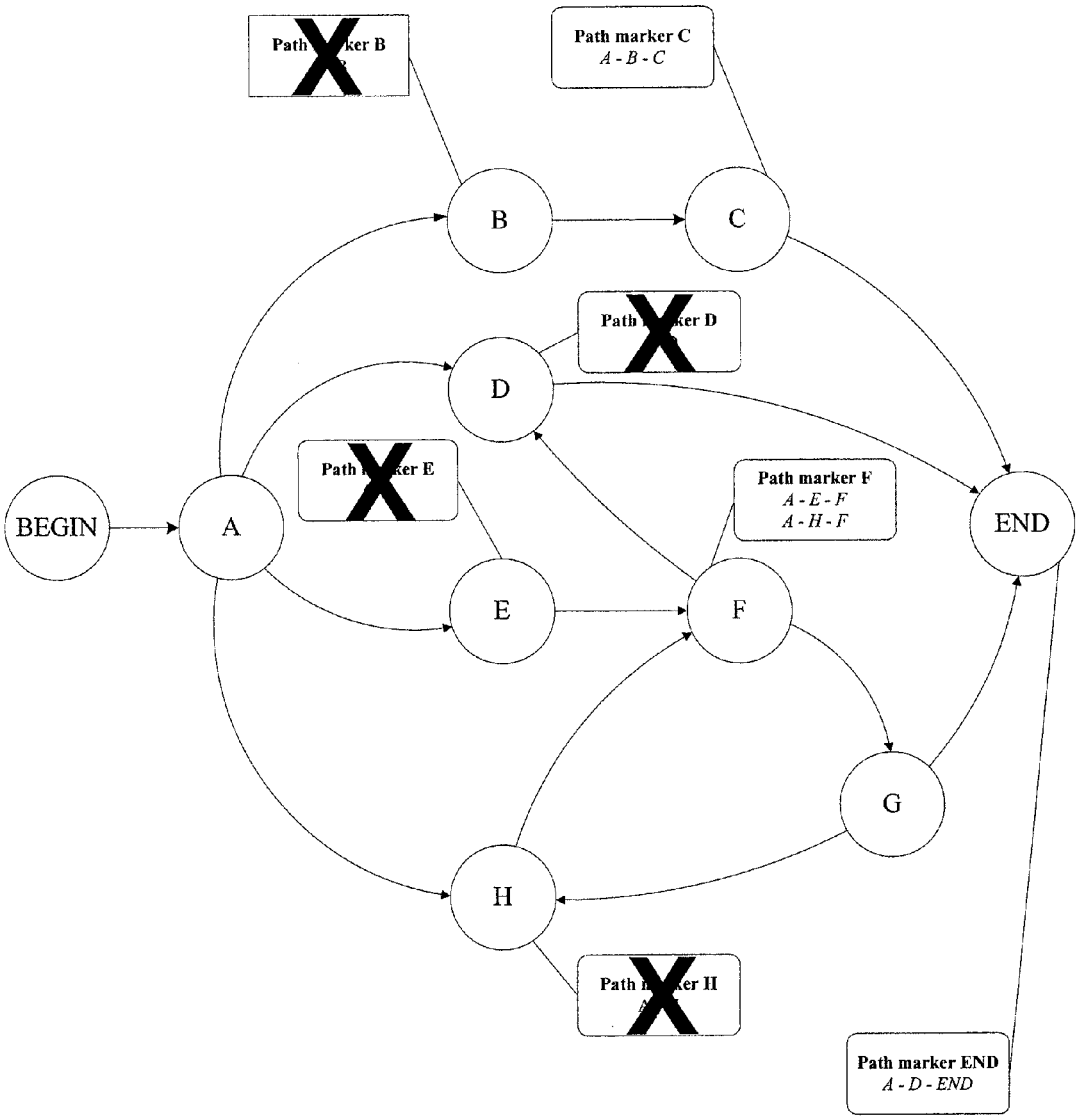

FIG. 5C shows the results of executing operations 304, 306, 308, 312, 314, 318, 320, 324, 326, and 328 in FIG. 3 to nodes B, E, and H as origin nodes in accordance with one embodiment of the present invention Similarly, operations 304, 306, 308, 312, 314, 318, 320, and 322 were executed to node D as an origin node. The path markers for the nodes B, D, E and H are shown as deleted while nodes C and F are shown as the next origin nodes. Also note that a completed path across the node structure has been logged in the path marker at the END node.

Figure 5D:
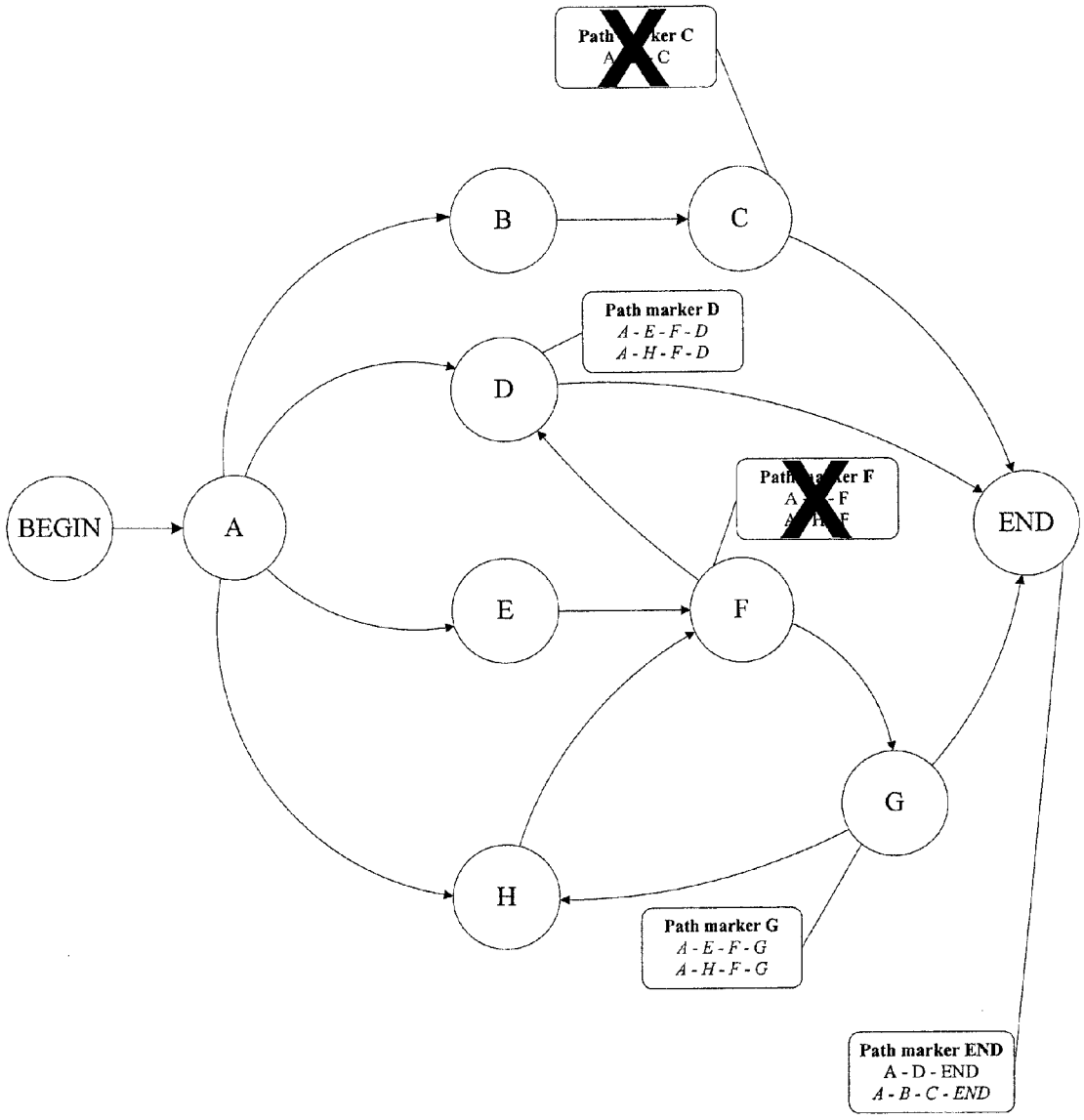

FIG. 5D illustrates the effect of performing operations found in FIG. 3 when nodes C and F are used as the origin nodes in accordance with one embodiment of the present invention. Another completed path across the FSA is logged in the END node path marker. The path markers for node C and F are shown as deleted while the path markers for nodes D, and G indicate that those will be the next origin nodes.

Figure 5E:
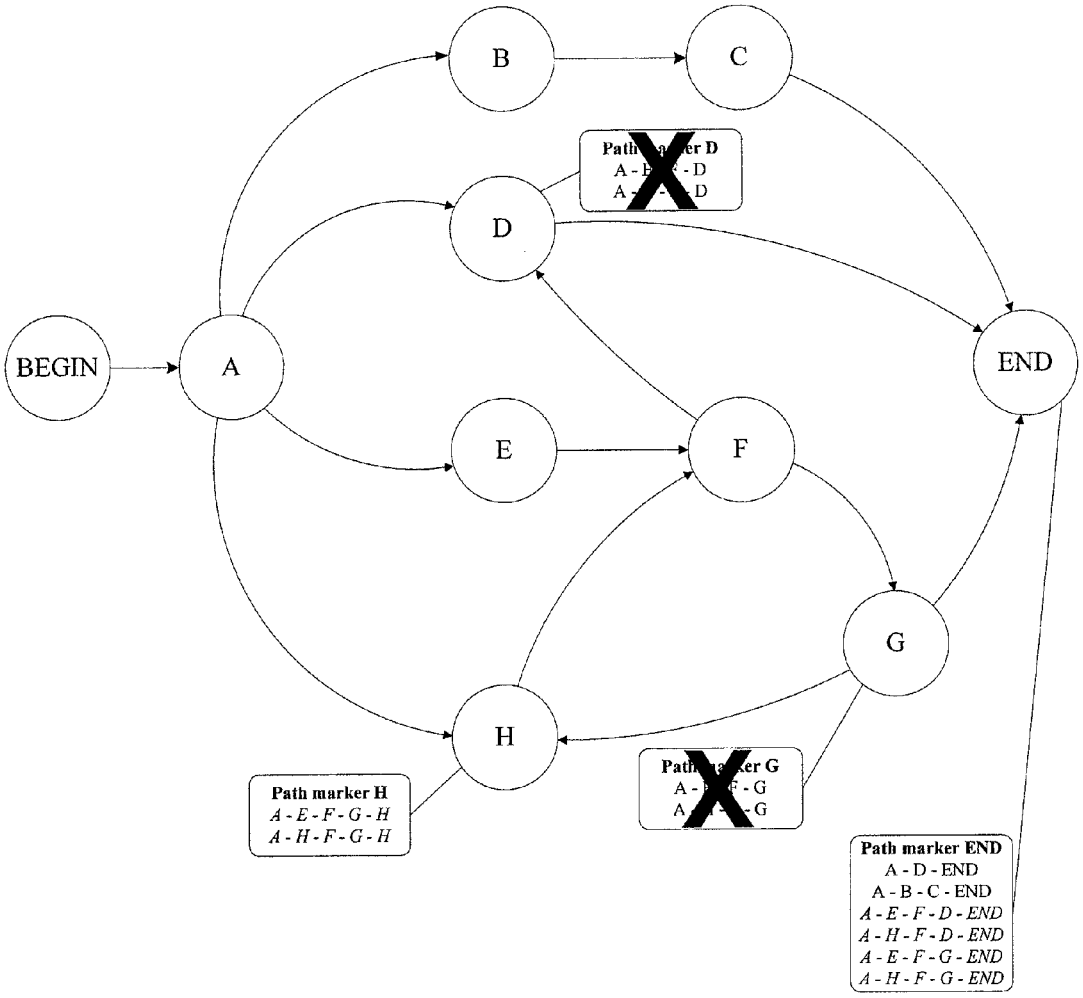

FIG. 5E shows the results of executing operations found in FIG. 3 when nodes D and G are used as the origin nodes in accordance with one embodiment of the present invention. The path markers from nodes D and G were recorded in the END node path marker. Additionally, before deleting the path markers at node G the unfollowed link to node H was taken. Thus, node H becomes the origin node and the operations in FIG. 3 are executed again.

Figure 5F:
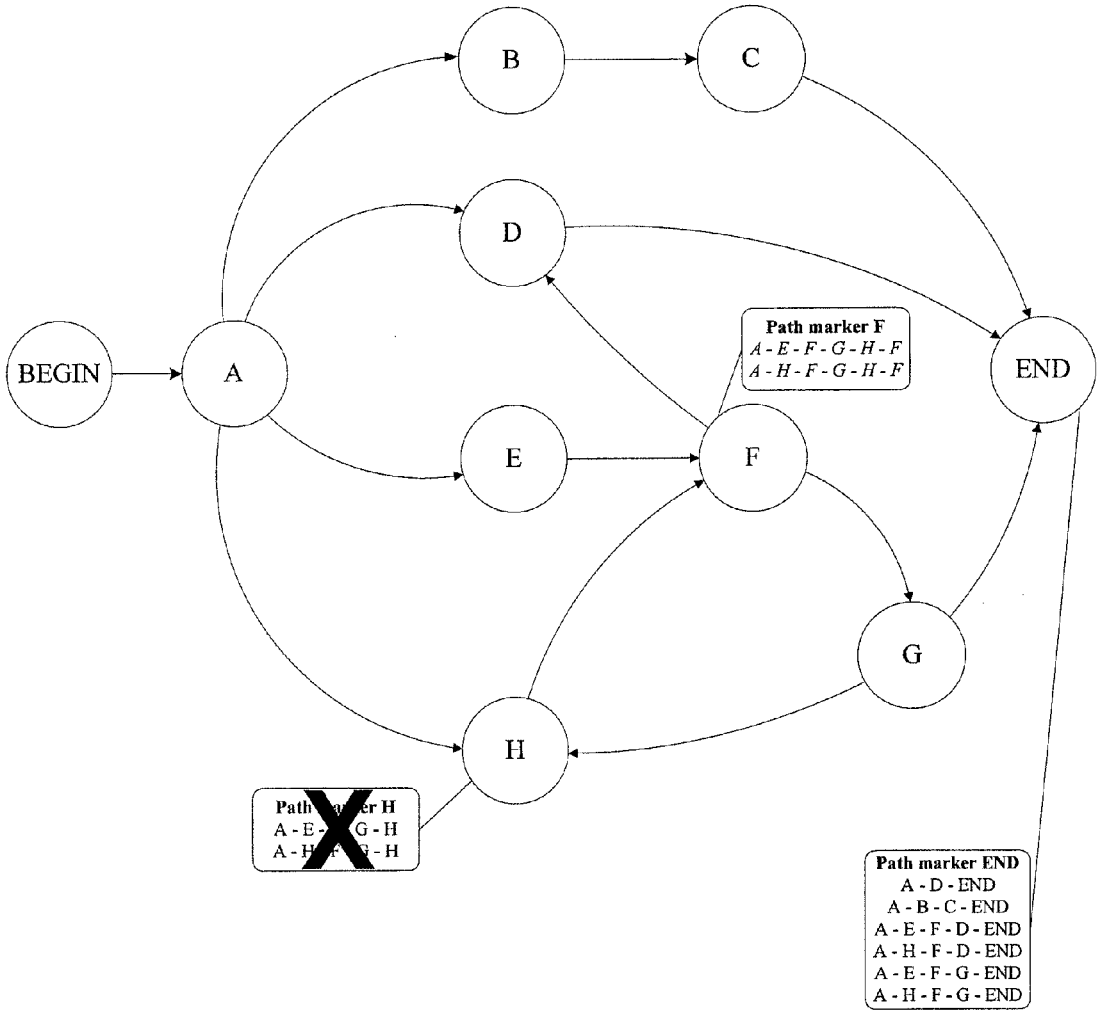
Figure 5G:
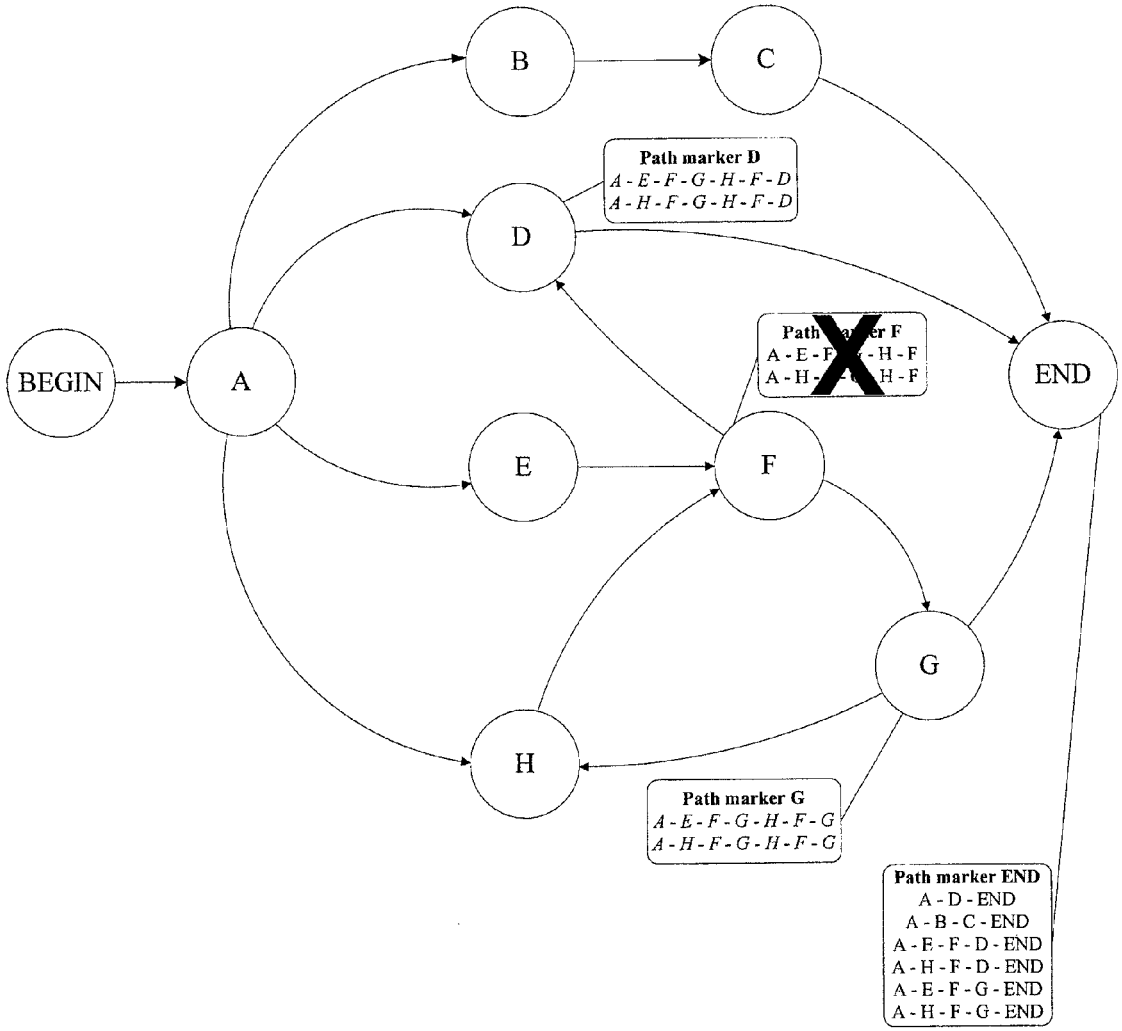
Figure 5H:
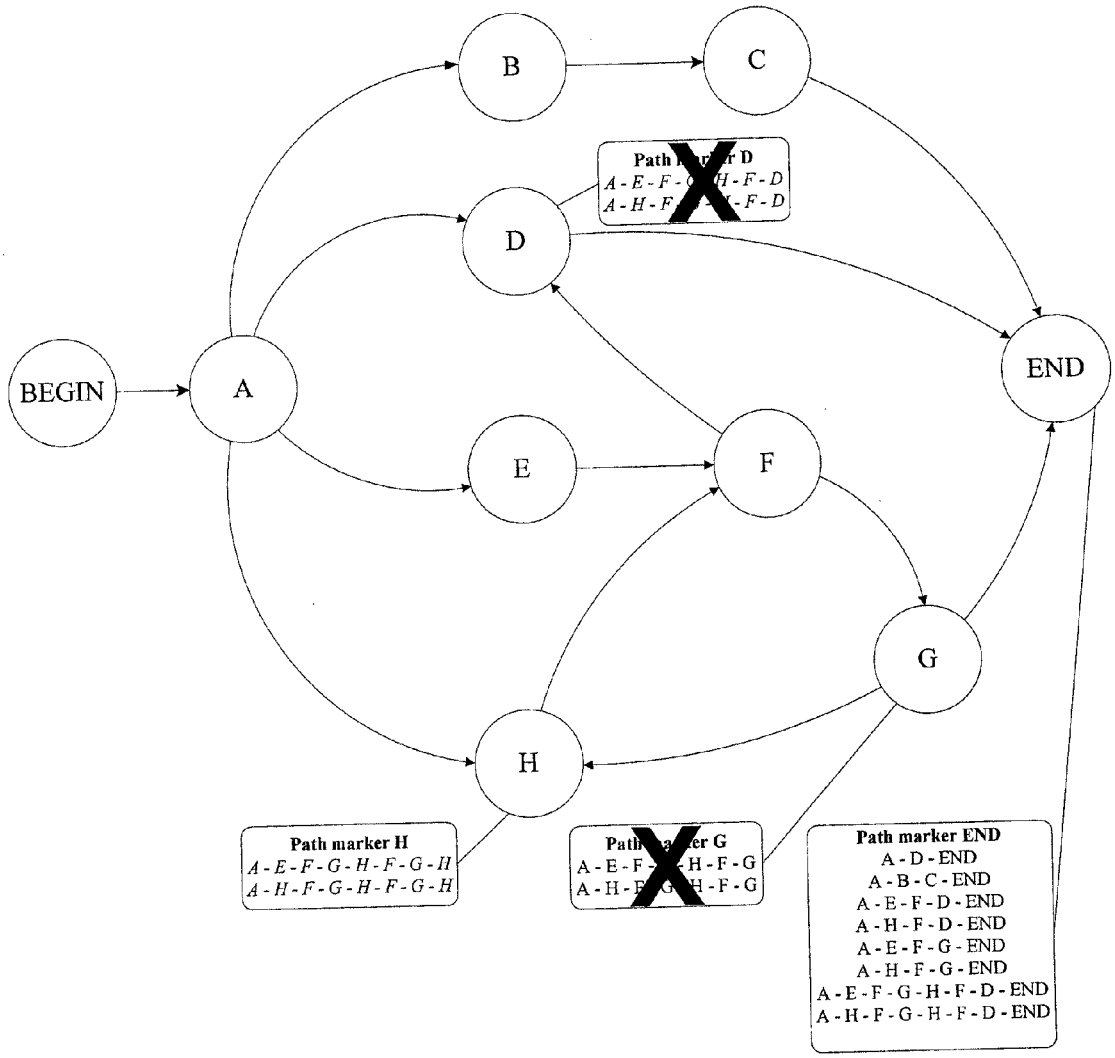

FIGS. 5F-5H continue to illustrate the results of performing the appropriate operations found in FIG. 3 in accordance with one embodiment of the present invention. The remaining part of the FSA continues to be traversed however, note that the nodes F, G, and H, present a problem because the graph exploration procedure can enter an infinite loop. To prevent the exploration from becoming mired in an infinite loop operation 314, from FIG. 3, checks if user defined exploration rules are violated. If the user defined exploration rules are violated, operation 316 writes to the origin node path marker registry that the departure link is blocked. Designating the departure link as blocked means that when operation 306 is performed the path marker history is written to the END node.

Figure 5I:
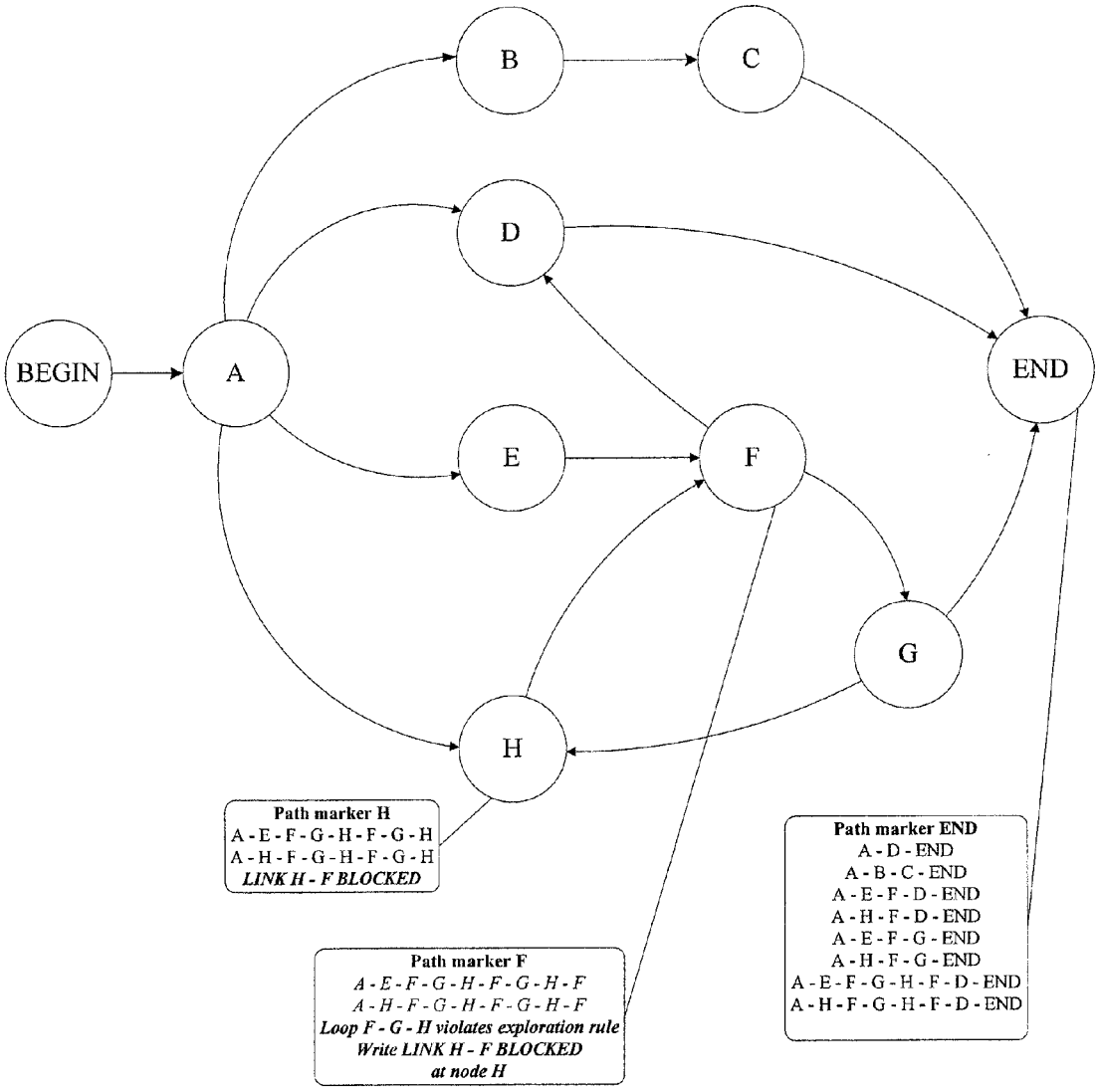

FIG. 5I demonstrates an exploration rule violation and writing to the origin node path marker registry in accordance with one embodiment of the present invention. The exploration rules, for this example only, examined three previous nodes and were set to block an incoming departure link if the nodes were encountered twice. Referring to FIG. 3 and FIG. 5I, node H is the origin node referenced in operation 302. The link between node H and node F is the unfollowed departure link for operation 304. Because the departure link to node H is not blocked, operation 306 results in the execution of operation 308 and operation 312. The ramification of those operations are shown in the path marker to node F in FIG. 5I. When operation 314 is conducted the exploration rules examine the path marker history at node F for two repetitions of three consecutive nodes. Seeing that the three nodes F, G, H have been repeated twice, the procedure advances to operation 316. The result of operation 316 is the recordation in the registry of the origin node, node H, that the link between node H and node F is blocked.

As an alternative, the exploration rules could have been configured to block a departure link when two nodes have been repeated in a path marker history more than three times. In that case, operation 314 would have blocked the link between node H and node F after seeing the combination of node H and node F three times in the path marker for node H in FIG. 5I. As another alternative the exploration rules could have been configured to block a departure link when two nodes have been repeated in a path marker more than twice. In that situation the departure link between node H and node F would have been blocked at the point shown in FIG. 5F because the combination of node H and node F is seen twice in the path marker for node F. The ability to specify the exploration rules enables users to control how the exploration procedure is used to traverse the FSA. In one embodiment the incomplete path marker history until the blocked link can be written to path marker history for the END node. Such an embodiment would result in a new music composition that does not fully traverse the node structure. Alternatively, in another embodiment, path marker histories that contain blocked links may not be recorded to the path marker history for the END node. Such an embodiment would be useful when a user wishes to record path marker histories that fully traverse the FSA. The examples provided are not intended to be restrictive and are provided to demonstrate how different exploration rules can impact the output of the graph exploration procedure.

Figure 5J:
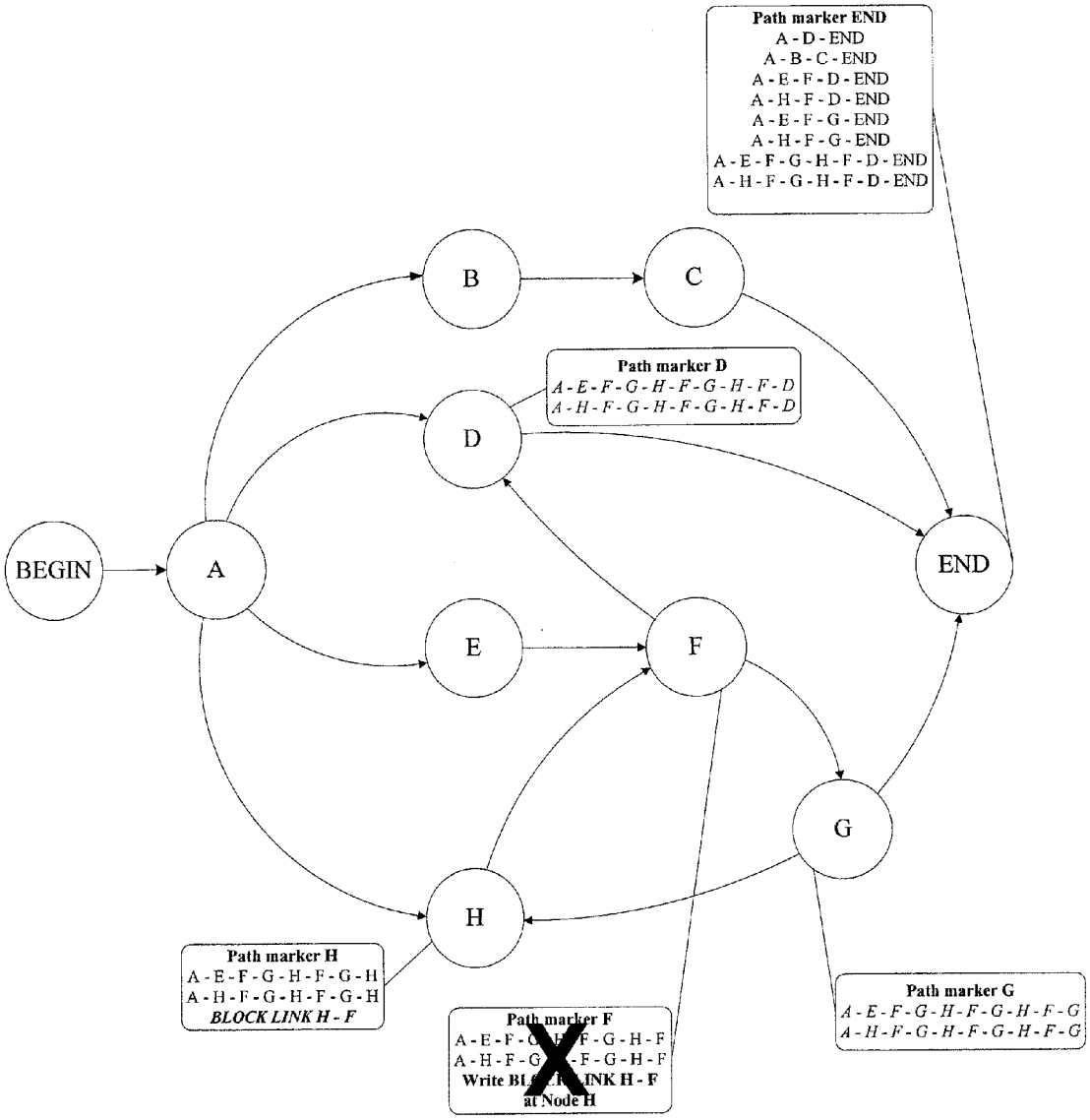
Figure 5K:
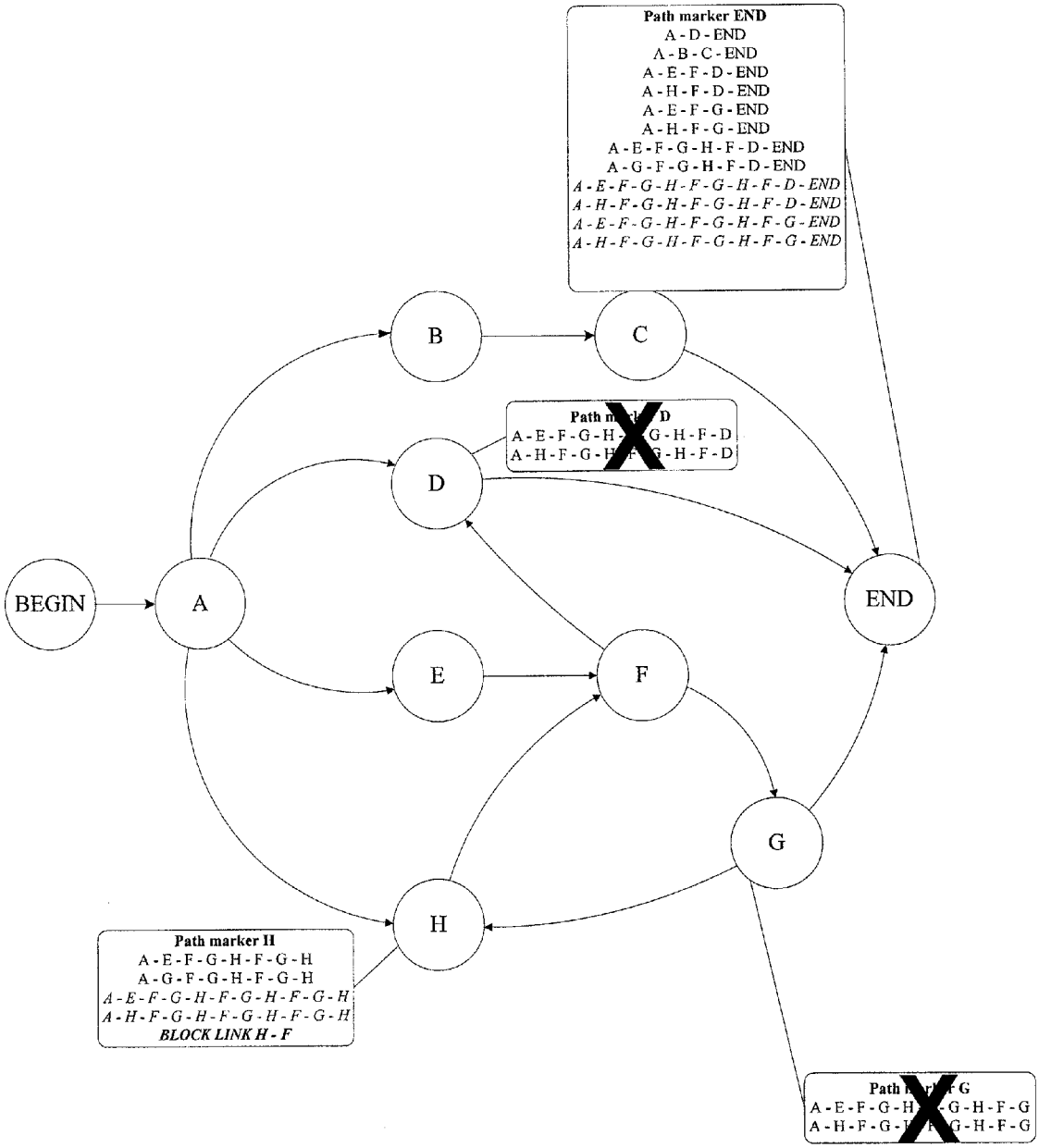

FIG. 5J and FIG. 5K shows the result of executing the processes outlined in FIG. 3, in accordance with one embodiment of the present invention. The result of FIG. 5J is that the path marker for node F is deleted and path markers are created at node D and node G. The result of FIG. 5K is that the path marker from node D reaches the END node and the path marker from node G is passed to node H. As indicated in the node H path marker registry the link between node H and node F is blocked. Without additional unblocked links to follow the graph exploration procedure has completed traversing the finite state automaton. The END node path marker history contains the node and link combinations as different paths that could be derived from traversing the given finite state automaton.

Many of the figures use words, phrases or letter designators because of the difficulty of representing sound in a written form. It should be understood that some of the same or similar techniques used to create a finite state automaton from words can be applied to the creation of a finite state automaton from sounds. For more information regarding creating finite state automata from words, reference may be made to co-owned U.S. Application: application Ser. No. 11/437,444, entitled, Structure for Grammar and Dictionary Representation in Voice Recognition and Method for Simplifying Link and Node-Generated Grammars, filed May 19, 2006 which is incorporated by reference herein.

When creating the finite state automaton using sounds there are many different aspects of sound that can be considered when determining if two nodes can be linked. Sound frequency and a corresponding duration have been previously discussed. In another embodiment it would also be possible to analyze the amplitude of the sound frequency. Using the amplitude as a factor in determining node linking would ensure that quite sounds are not mixed with loud sounds. In another embodiment, a frequency with a duration that exceeds a specified time period can be analyzed for changes in amplitude. For example, a sustained note/sound may have a crescendo or diminuendo. Detecting the change in amplitude would make it possible to match nodes with similar amplitudes and the proper frequency at the beginning and ending of the sustained note/sound.

Although the END node path marker history in FIG. 5J is populated with combinations of nodes represented by letters, each letter could represent a different note/sound. In one embodiment, the nodes can represent sound as a frequency and duration, as found in written music. In another embodiment, the nodes can represent a sound recording where a frequency has at least duration and amplitude. Thus, the sequences of linked nodes/sounds found in the END node path marker history can be viewed as music even though they are shown as letter sequences. The END node path markers may include the original input sound sequence along with new sound sequences.

One of the many benefits of analyzing input sounds and creating a finite state automaton is that the sounds do not need to be transcribed into a written format. This enables embodiments of the invention to be used with all forms of music including those with no written form. Thus, when the finite state automaton created by input sounds is traversed by the graph exploration procedure it is possible that cultural and ethnics themes, motifs, and harmonies will be replicated and modified in the resulting new music.

It should also be noted that the disclosed techniques capable of generating new sound sequences could be applied to other technology areas, such as, text sentence generation in any given language. To generate new sentences, input sentences could be converted into a finite state automaton and grammar rules could supplement the graph exploration procedure and exploration rules to foster the creation of coherent logical sentences. Accordingly, with the various applications in mind, it will be well understood that the described embodiments and equivalent modifications have a multitude of useful applications. The invention may be practiced with other computer system configurations including game consoles, gaming computers or computing devices, hand-held devices, microprocessor systems, microprocessor-based or programmable consumer electronics, minicomputers, mainframe computers and the like. The invention may also be practiced in distributing computing environments where tasks are performed by remote processing devices that are linked through a network. For instance, on-line gaming systems and software may also be used.

With the above embodiments in mind, it should be understood that the invention may employ various computer-implemented operations involving data stored in computer systems. These operations are those requiring physical manipulation of physical quantities. Usually, though not necessarily, these quantities take the form of electrical or magnetic signals capable of being stored, transferred, combined, compared, and otherwise manipulated. Further, the manipulations performed are often referred to in terms, such as producing, identifying, determining, or comparing.

Any of the operations described herein that form part of the invention are useful machine operations. The invention also relates to a device or an apparatus for performing these operations. The apparatus may be specially constructed for the required purposes, such as the carrier network discussed above, or it may be a general purpose computer selectively activated or configured by a computer program stored in the computer. In particular, various general purpose machines may be used with computer programs written in accordance with the teachings herein, or it may be more convenient to construct a more specialized apparatus to perform the required operations.

The invention can also be embodied as computer readable code on a computer readable medium. The computer readable medium is any data storage device that can store data, which can thereafter be read by a computer system. Examples of the computer readable medium include hard drives, network attached storage (NAS), read-only memory, random-access memory, FLASH based memory, CD-ROMs, CD-Rs, CD-RWs, DVDs, magnetic tapes, and other optical and non-optical data storage devices. The computer readable medium can also be distributed over a network coupled computer systems so that the computer readable code is stored and executed in a distributed fashion.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A method for dynamically analyzing input sounds and processing the input sounds to define a new set of output sounds, comprising:

receiving a first set of input sounds and a second set of input sounds, each of the first and second sets of input sounds being processed to identify one of a tone, intensity, or frequency, and a duration;

defining a node for each identified input sound and a link between the input sounds of the first and second sets of input sounds, the nodes and links from the first and second sets of input sounds creating a respective first and second finite state automata;

defining a history value for processing the nodes of the first and second sets of input sounds, the history value defining a number of preceding nodes that will be identical in each of the first and second sets of input sounds before a particular node is shared between the first and second sets of input sounds; and forming the new set of output sounds from a third finite state automaton that includes nodes from the first and second set of input nodes and nodes that are shared based on meeting the history value.

2. The method as recited in claim 1, wherein forming the new set of output sounds from the third finite state automaton includes, traversing the third finite state automaton using path markers.

3. The method as recited in claim 1, wherein paths across the third finite state automaton are recorded in the path markers.

4. The method as recited in claim 1, wherein the new set of output sounds are defined by one or more of the paths across the third finite state automaton.

5. Computer readable media having program instructions for dynamically analyzing input sounds and processing the input sounds to define a new set of output sounds, the computer readable media, comprising:

program instructions for receiving a first set of input sounds and a second set of input sounds, each of the first and second sets of input sounds being processed to identify one of a tone, intensity, or frequency, and a duration;

program instructions for defining a node for each identified input sound and a link between the input sounds of the first and second sets of input sounds, the nodes and links from the first and second sets of input sounds creating a respective first and second finite state automata;

program instructions for defining a history value for processing the nodes of the first and second sets of input sounds, the history value defining a number of preceding nodes that will be identical in each of the first and second sets of input sounds before a particular node is shared between the first and second sets of input sounds; and program instructions for forming the new set of output sounds from a third finite state automaton that includes nodes from the first and second set of input nodes and nodes that are shared based on meeting the history value.

6. The computer readable media as recited in claim 5, wherein forming the new set of output sounds from the third finite state automaton includes, traversing the third finite state automaton using path markers.

7. The computer readable media as recited in claim 5, wherein paths across the third finite state automaton are recorded in the path markers.

8. The computer readable media as recited in claim 5, wherein the new set of output sounds are defined by one or more of the paths across the third finite state automaton.

9. A method, comprising:

obtaining a first set of input sounds and a second set of input sounds, each of the first and second sets of input sounds being processed to identify one of a tone, intensity, or frequency, and a duration;

identifying a node for each identified input sound and a link between the input sounds of the first and second sets of input sounds, the nodes and links from the first and second sets of input sounds creating a respective first and second finite state automata;

assigning a history value for processing the nodes of the first and second sets of input sounds, the history value defining a number of preceding nodes that will be identical in each of the first and second sets of input sounds; and generating a new set of output sounds from a third finite state automaton that includes nodes from the first and second set of input nodes and nodes that are shared based on meeting the history value.

10. The method as recited in claim 9, wherein forming the new set of output sounds from the third finite state automaton includes, traversing the third finite state automaton using path markers.

11. The method as recited in claim 9, wherein paths across the third finite state automaton are recorded in the path markers.

12. The method as recited in claim 9, wherein the new set of output sounds are defined by one or more of the paths across the third finite state automaton.

* * * * *